US006471599B2

(12) United States Patent
Ford

(10) Patent No.: US 6,471,599 B2
(45) Date of Patent: Oct. 29, 2002

(54) GOLF CLUB FOR TEACHING BALL ALIGNMENT AND LIE ANGLE

(76) Inventor: John S. Ford, 2940 S. Horseshoe Dr. Suite 1000, Naples, FL (US) 34101

( * ) Notice: Subject to any disclaimer, the term of this patent is extended or adjusted under 35 U.S.C. 154(b) by 0 days.

(21) Appl. No.: 09/768,406

(22) Filed: Jan. 24, 2001

(65) Prior Publication Data

US 2002/0098900 A1 Jul. 25, 2002

(51) Int. Cl.[7] ..... A63B 69/36
(52) U.S. Cl. ..... 473/242; 473/248
(58) Field of Search ..... 473/237, 238, 473/242, 244, 245, 246, 247, 248, 231, 252, 268; D21/474, 748, 749, 750, 751

(56) References Cited

U.S. PATENT DOCUMENTS 1,046,343 A * 12/1912 Smith
1,485,272 A * 2/1924 Kinsman
D83,700 S * 3/1931 Schmermund
D101,108 S * 9/1936 Ellingham
2,820,638 A * 1/1958 Morrison
D192,366 S * 3/1962 Penna
3,955,819 A * 5/1976 Yokcih
4,157,830 A * 6/1979 Taylor
4,231,576 A * 11/1980 Perkins
D345,191 S * 3/1994 Iinuma
5,603,668 A * 2/1997 Antonious
D388,486 S * 12/1997 Mahaffey
D445,862 S * 7/2001 Ford

FOREIGN PATENT DOCUMENTS

GB 243435 * 11/1925

OTHER PUBLICATIONS

Gold Digest, Dec. 1977, p. 101 (Class 273/Subs 167F).*

* cited by examiner

*Primary Examiner*—Sebastiano Passaniti
(74) *Attorney, Agent, or Firm*—Edwin W. Oldham; Hahn Loeser + Parks LLP

(57) ABSTRACT

This invention relates to a marking system for a golf iron which provides a visual marking system to facilitate the positioning of the ball laterally with respect to the club face, as well a marking system on the bottom flange of the club which facilitates the determination of lie angle, and a bullseye marking at the sweet spot of the club face. The markings make it possible to facilitate club fitting.

4 Claims, 3 Drawing Sheets

GOLF CLUB FOR TEACHING BALL ALIGNMENT AND LIE ANGLE

The invention relates to an improved club designed to facilitate the positioning of the ball properly laterally with respect to the club face, and to facilitate the establishment of the proper lie angle of the club head.

BACKGROUND OF THE INVENTION

Heretofore, there has not been a good system incorporated into the club head itself which facilitates the proper positioning of the ball laterally with respect to the club head, nor has there been a system which allows within the club head itself to assist in determination of the proper lie angle for the bottom of the club with respect to the ground. The present invention provides a solution to these situations.

BRIEF DESCRIPTION OF THE DRAWINGS

For a better understanding of the invention, reference should be had to accompanying drawings wherein.

DETAILED DESCRIPTION OF THE INVENTION

Figure 1:
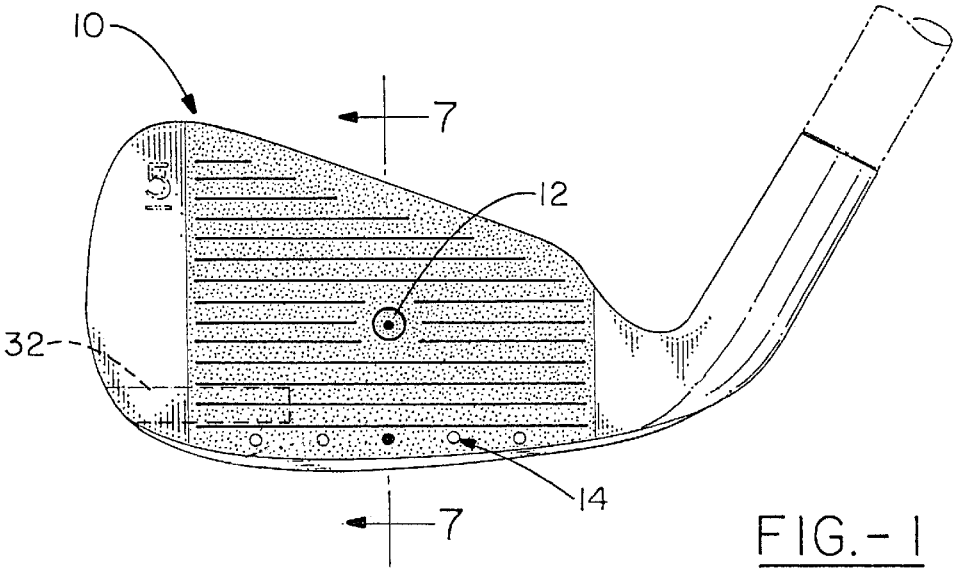
FIG. 1 is a front elevational view of the preferred new design for the golf iron which shows the alignment system along the bottom of the face of the club.

Now, with reference to the preferred embodiment of the invention as depicted in the drawings, the invention will be described. Referring particularly to FIG. 1, the numeral 10 indicates generally a golfing iron which incorporates the improvements of the invention. As seen in FIG. 1, the improvements incorporate the centrally positioned sweet spot marking 12 which is preferably a circular bullseye. Additionally, the bottom of the club face incorporates a plurality of laterally positioned indentations indicated generally by numeral 14. The purpose of the small circular indentations 14 will be described later.

Figure 2:
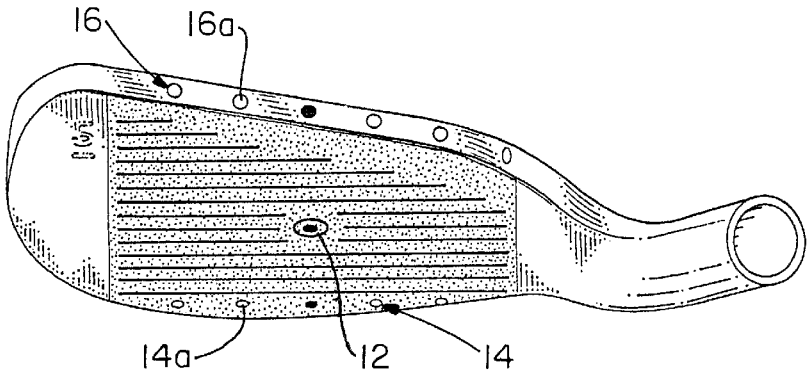
FIG. 2 is a top perspective view of the club of FIG. 1 showing the lateral alignment system on both the top edge of the club and along the bottom of the face.

With reference to FIG. 2, a series of small circular indentations indicated generally by numeral. 16 are shown as positioned along the top edge of the upper flange of the club, indicated by numeral 18. The circular indentations 14 and 16 are aligned with each other vertically, and are visible to the person using the club when the person looks down onto the club in the view of FIG. 2. These indents 14 and 16 provide a visual alignment reference for the person using the club, particularly for positioning the golf ball at the optimum position laterally on the club face at initial address. More specifically, the club fitter will utilize ball impact tape on the face of the club, and record ball impact position for the player's swing characteristics, and determine the optimum lateral address positioning of the ball for optimum sweet spot ball striking at impact. The club fitter will make the appropriate individual indent 14 and 16 with a color so the golfer can accurately position the ball properly laterally on the club face at address. It is well known that every golfer tends to have their own characteristics in their swing, and that these characteristics are generally repeated on every swing. The club face impact tape will show a pattern of where ball position is on the club face at impact, and if it is not on or about at the sweet spot 12, then the golfer will be instructed to address the ball with the ball moved laterally with respect to the club face so that if the golfer then takes the same characteristic swing, the ball impact would then be on or very close to the sweet spot. Thus, once the club fitter or golf teaching professional has helped the individual golfer determine the proper positioning of the ball along the lateral club face to achieve proper sweet spot ball impact, then it is very much easier for that golfer to get the same and proper alignment of the ball to the club face by using the appropriate indents 14 and 16 as alignment guides. For example, suppose that the testing with the impact tape showed that the golfer hit the ball more closely to the sweet spot 12 when the ball was positioned at address at the indents 14*a* and 16*a*, so the golfer when approaching address position would simply make sure that the ball was positioned in alignment with colored indents 14*a* and 16*a*.

Preferably the indents 14 and 16 are substantially equally spaced apart, but are designed to be in alignment when viewed by the golfer in address position. Particularly as the indents 16 come down the top flange toward the hosel the spacing may vary so the alignment visually to the golfer at address will be an alignment of similarly positioned indents 14 and 16.

Figure 3:
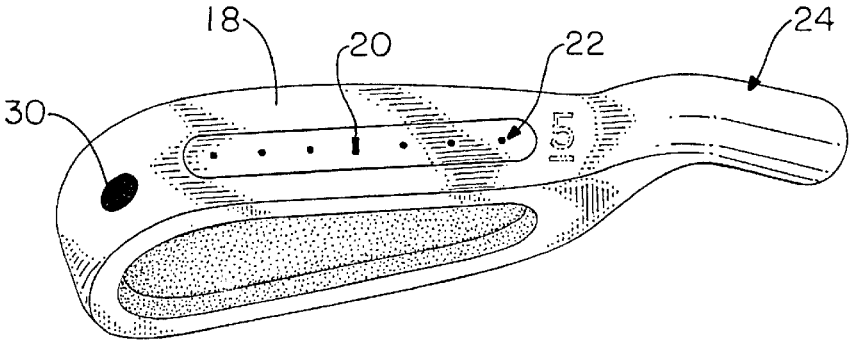
FIG. 3 is a bottom perspective view of the club of FIG. 1 which shows the lie angle markings on the bottom of the club head.
Figure 4:
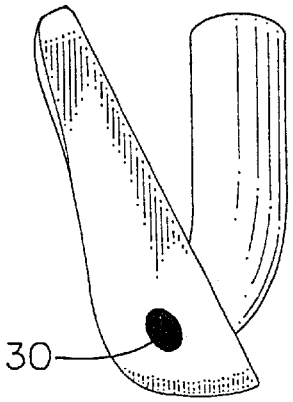
FIG. 4 is an elevational view of the toe end of the club showing the weight balancing plug located at the toe of the club.
Figure 5:
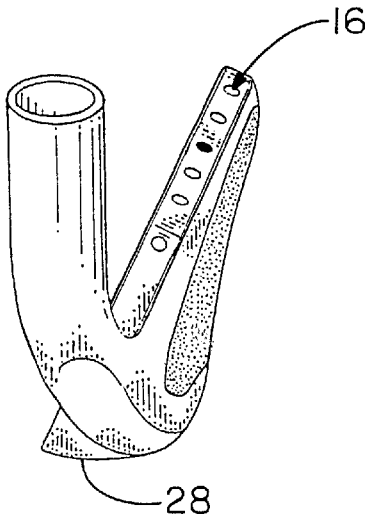
FIG. 5 is an elevational view of the heel end of the club looking down the top flange and seeing the lateral ball alignment indentations in the top flange of the club.

Turning now to the lie angle adjustment characteristics of the invention, reference should be made to FIG. 3 where numeral 18 indicates generally markings on the sole of the club that include a central sweet spot location shown by numeral 20. Then equally spaced marks are provided on each side of the central mark 20, these being generally indicated by numeral 22. The use of these marks greatly simplifies the proper measurement of lie angle, and hence adjustment of the club to get the proper lie angle. The club adjuster and fitter, or golf professional uses a thin vinyl or metallic tape along the sole of the club, as is well known in the industry, and then has the golfer swing the club and hit a hitting board at the bottom of the swing, which is equivalent to hitting the board at the same point in the swing where ball contact would occur. The thin tape is then scraped clean at the point along the club sole where contact was made with the hitting board. Optimally, the tape is scraped off at the central point 20 which would show proper lie angle at impact, and hence an optimal contact of the ball on the sweet spot of the club face. However, if the tape is actually scraped off toward the toe of the club which exposes some of the marks 22 to the left or toe side of the sole as seen in FIG. 3, then the lie angle of the club must be adjusted to fit that particularly player's swing characteristics. This is done by bending the hosel of the club somewhere in the vicinity of numeral 24, by whatever degree was determined by the location of the scraped off portion of the tape applies to the sole. The separation of the marks 22 is such that the distance between each mark 22 equals about 1 degree of angle that the lie angle should be adjusted so that the club is then custom fitted to the individual golfer.

Turning now to other features of the golf club of this invention, reference should be made to FIGS. 2 and 3 where numeral 30 illustrates a closed end of cavity 32 shown in FIG. 2 as a chain dotted line. The cavity 32 can receive some heavier metal and thus depending on the amount of weight added can selectively provide some toe weight, and have a tendency to reduce slices of the golf ball, by selectively making the club toe heavy. For example, melted lead could be poured into cavity 32 of the selected amount of weight determined to be added, and then the cover 30 replaced.

Figure 6:
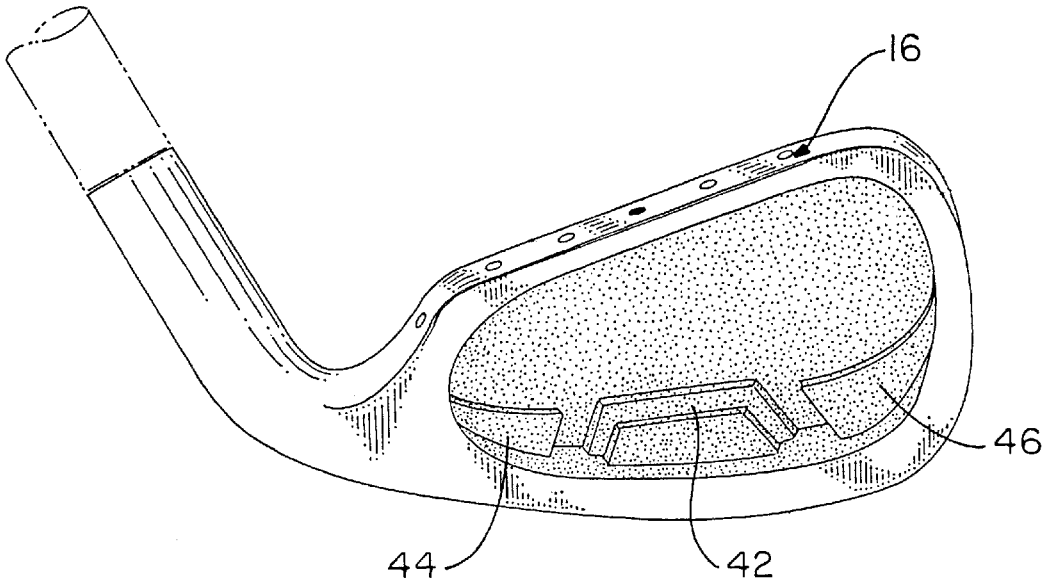
FIG. 6. is an elevational view of the back of the club head showing the cavity on the back, the weight positioning at the bottom edge of the cavity, as well as the alignment indents on the top flange of the club head.
Figure 7:
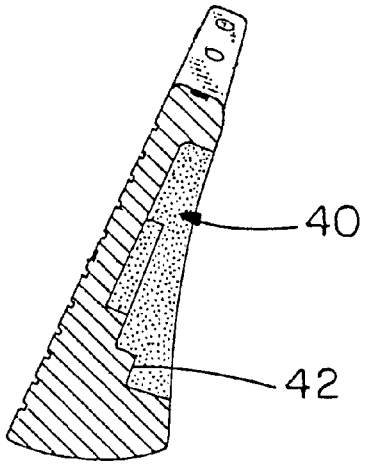
FIG. 7 is a cross-sectional view taken on lines 7—7 of FIG. 1 of the club head of the invention.

FIGS. 6 and 7 illustrate the addition of weight to the bottom edge of the cavity 40 formed on the back of the clubface. As best seen in FIG. 6 more weight as illustrated by numeral 42 is centrally added essentially in alignment with the sweet spot, and then lesser weight is actually tapered to each side as illustrated by numbers 44 and 46. The weight positioned at the bottom edge of the cavity 40 lowers the sweet spot 12 and hence lets ball impact be close to the sweet spot when the ball is hit off the ground, thus achieving better energy transfer from the club head to the golf ball. The open cavity 40 is a well-known design to enlarge the sweet spot. The lateral tapering of the side weights 44 and 46 helps focus the bottom weighting more toward the center, and hence gives better performance of the club at the sweet spot 12.

It should be understood that for the club fitter the proper sequence of fitting will be to first determine proper lie angle and adjust the club to the proper lie angle, and then to use the lateral positioning system to determine the proper indents 14 and 16 to color code for the swing of the golfer being fitted.

Thus, it should be understood that the invention achieves an optimum fitting system for professional club fitting to properly fit individual golfers to lie angle and lateral ball positioning to thereby achieve optimum performance, to hit the ball as near to the sweet spot as possible on every shot.

Now, in accordance with the patent statutes only the best known embodiment of the invention has been described, but the invention is not meant to be limited thereto or thereby, by the scope of the invention as set forth in the attached claims.

What is claimed is:

1. A golf club iron which includes a club face, a top flange, a bottom sole, a toe, and a heel, and said iron being of a first or primary color which is characterized by having more than three substantially equally spaced markers positioned laterally across the full width of the club from toe to heel and where they are visible to the club user to facilitate the lateral positioning of the ball relatively to the club face at address, and wherein only one of said lateral positioning markers is of a second or secondary color to distinguish from the primary color of the iron and to selectively identify the proper lateral positioning of the ball relative to the club face at address by the club user.

2. A golf club iron as defined in claim 1 wherein the markers are positioned across the full width of the top flange.

3. A golf club iron as set forth in claim 2 wherein additional markers are positioned along the full width of the bottom edge of the club face adjacent the flange and in vertical alignment with the markers along the top flange.

4. A golf club iron according to claim 2 which includes a lie angle marking positioned along the bottom sole with a central point in alignment with the sweet spot, and lateral points equally spaced on both sides of the central point.

* * * * *